US006522300B2

(12) United States Patent
Oshiyama et al.

(10) Patent No.: US 6,522,300 B2
(45) Date of Patent: Feb. 18, 2003

(54) ANTENNA DEVICE FOR MOBILE TELE-COMMUNICATION TERMINAL

(75) Inventors: Tadashi Oshiyama, Tokyo (JP); Atsushi Sato, Tokyo (JP); Katsutoshi Okubo, Tokyo (JP); Takao Kawahara, Tokyo (JP); Seiji Gou, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 10/029,389

(22) Filed: Dec. 28, 2001

(65) Prior Publication Data

US 2002/0126050 A1 Sep. 12, 2002

(30) Foreign Application Priority Data

Dec. 28, 2000 (JP) ..... 2000-400747
Feb. 21, 2001 (JP) ..... 2001-044823

(51) Int. Cl.[7] ..... H01Q 1/24
(52) U.S. Cl. ..... 343/702
(58) Field of Search ..... 343/702, 845, 343/850, 852, 853, 860, 893, 900, 901

(56) References Cited

U.S. PATENT DOCUMENTS 4,914,714 A * 4/1990 Tamura ..... 455/78
5,722,089 A * 2/1998 Murakami ..... 455/575
5,794,158 A * 8/1998 Itoh ..... 455/550
5,812,097 A * 9/1998 Maldonado ..... 343/790
6,154,177 A * 11/2000 Saito et al. ..... 343/702
6,341,216 B1 * 1/2002 Itoh ..... 455/83
6,344,826 B1 * 2/2002 Matsuura et al. ..... 343/702
6,393,264 B1 * 5/2002 Scholz ..... 455/180.1
6,469,669 B1 * 10/2002 Tran ..... 343/702

* cited by examiner

*Primary Examiner*—Don Weng
*Assistant Examiner*—Shih-Chao Chen
(74) *Attorney, Agent, or Firm*—Morgan, Lewis & Bockius LLP

(57) ABSTRACT

A whip antenna is movable between a first position corresponding to a state in which the whip antenna is extended from a casing of the mobile communication terminal, and a second position corresponding to a state the whip antenna is accommodated within the casing. A built-in antenna is disposed within the casing. A power feeding circuit is disposed within the casing. A first matching circuit has a first impedance, through which the power feeding circuit and the whip antenna are electrically connected when the whip antenna is placed at the first position. A second matching circuit has a second impedance which is higher than the first impedance, through which the whip antenna is grounded when the whip antenna is placed at the second position. A switch mechanism is opened so that the built-in antenna is electrically disconnected from the power feeding circuit when the whip antenna is placed at the first position, and closed so that the built-in antenna is electrically connected to the power feeding circuit.

5 Claims, 6 Drawing Sheets

ANTENNA DEVICE FOR MOBILE TELE-COMMUNICATION TERMINAL

BACKGROUND OF THE INVENTION

The present invention relates to an antenna device for use with a mobile communication terminal, and more particularly, to an antenna device for use with a cellular phone.

Cellular phones are used in various countries. As shown in FIGS. 8A through 8D, an antenna is classified into several different types, which vary from country to country. FIG. 8A shows a whip antenna of top loading type in the extended state and in the housed state. FIG. 8B shows an antenna of bottom loading type in the extended state and in the housed state. The cellular phones shown in FIGS. 8A and 8B are of retractable type. FIG. 8C shows an antenna of externally fixed type, and FIG. 8D shows an antenna of built-in type.

An antenna which is a combination of a retractable-type antenna and a built-in-type antenna has recently been proposed. The reason for employment of such a hybrid type is that a deficiency arises in the sensitivity of an antenna when either one of the external fixed type or the built-in type is adopted, which in turn interferes with communication. An additional reason is that, in terms of design, demand exists for an antenna structure which eliminates projection which would otherwise arise when an antenna is stored.

Satisfying both requirements requires a structure which connects a feeding circuit to a whip or built-in antenna by way of a changeover switch.

However, no switch suitable for use as such a changeover switch has hitherto been available. Changeover switches are classified into an electrical switch using a pin diode, and a mechanical switch. When an electric current passes through a changeover switch of former type, a large loss arises. A changeover switch of latter type includes a high-frequency switch which involves a lower passage loss but is bulky and expensive. Thus, both types of changeover switches involve problems.

SUMMARY OF THE INVENTION

The present invention has been conceived in consideration of the foregoing point and aims at providing an antenna for a compact mobile communication terminal which enables mechanical switching between a whip antenna and a built-in antenna and involves lower signal loss.

In order to achieve the object, according to the present invention, there is provided an antenna device for a mobile communication terminal, comprising:

- a whip antenna, which is movable between a first position corresponding to a state in which the whip antenna is extended from a casing of the mobile communication terminal, and a second position corresponding to a state the whip antenna is accommodated within the casing;
- a built-in antenna, disposed within the casing;
- a power feeding circuit, disposed within the casing;
- a first matching circuit having a first impedance, through which the power feeding circuit and the whip antenna are electrically connected when the whip antenna is placed at the first position;
- a second matching circuit having a second impedance which is higher than the first impedance, through which the whip antenna is grounded when the whip antenna is placed at the second position; and

- a switch mechanism, which is opened so that the built-in antenna is electrically disconnected from the power feeding circuit when the whip antenna is placed at the first position, and closed so that the built-in antenna is electrically connected to the power feeding circuit.

DETAILED DESCRIPTION OF THE PREFERRED EMBODIMENTS

Figure 1A:
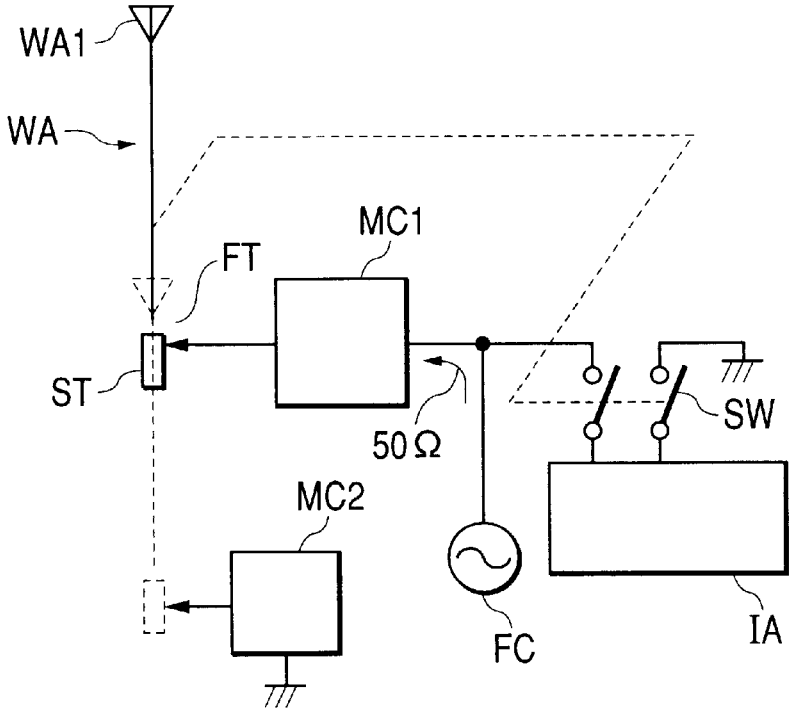
FIG. 1A is a schematic diagram showing the configuration of a cellular phone according to a first embodiment of the present invention, showing a connection state when a whip antenna is used.
Figure 1B:
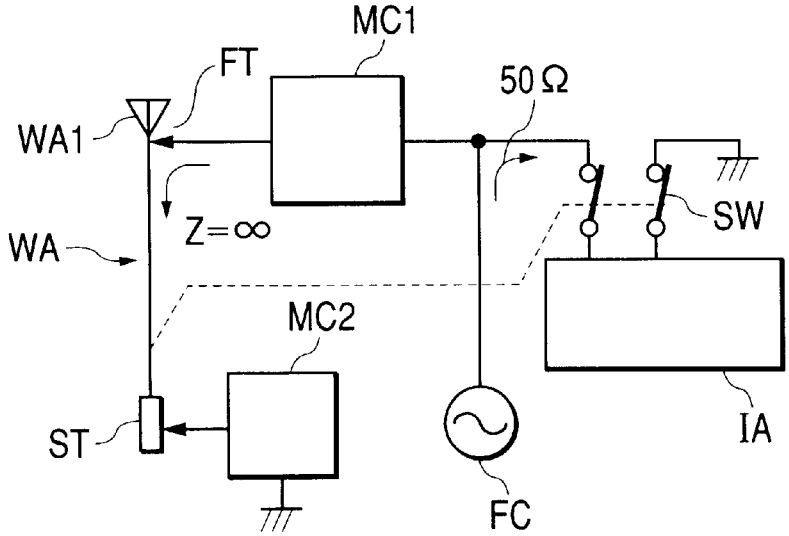
FIG. 1B is a schematic diagram showing the cellular phone according to the first embodiment, showing a connection state when a built-in antenna is used.

Preferred embodiments of the present invention will be described in detail hereinbelow by reference to the accompanying drawings. FIGS. 1A and 1B are schematic diagrams showing the configuration of an antenna according to a first embodiment of the present invention.

As is evident from the drawings, a whip antenna WA and a built-in antenna IA are employed as antenna members. One of these antenna members is selectively connected to a feeding circuit FC, by switching action of a switch SW which opens and closes in conjunction with actions of withdrawing and storing the whip antenna WA.

As shown in FIG. 1A, the whip antenna WA is withdrawn from the main body of the mobile communication terminal by grasping and drawing an antenna top WA1. The thus-withdrawn whip antenna WA is connected to the feeding circuit FC by way of a stopper ST, a feeding terminal FT, and an impedance matching circuit MC1. By the switch SW, which is open at this time, the built-in antenna IA is disconnected from the feeding circuit FC.

As shown in FIG. 1B, the whip antenna WA is housed in the main body of the mobile communication terminal. By the switch SW, which is closed at this time, the built-in antenna IA is connected to the feeding circuit FC and grounded. Alternatively, another conceivable circuit configuration which obviates a necessity for grounding is employed.

A portion of the whip antenna WA located in the vicinity of the antenna top WA1 is connected to the feeding terminal FT through capacitance coupling, whereby the whip antenna WA is connected to the impedance matching circuit MC1. Further, the whip antenna WA is connected to a matching circuit MC2 by the stopper ST. The matching circuit MC2 is higher in impedance than the feeding circuit FC. The matching circuit MC2 is a parallel resonant circuit constituted of, for example, a chip coil and a capacitor.

Viewing this state from the feeding circuit FC, the built-in antenna IA is connected while the impedance matching is performed. On the other hand, the whip antenna WA is coupled under the high-impedance state. Therefore, only the built-in antenna IA is activated in this state.

The impedance matching circuit MC1 is connected to the whip antenna WA and the built-in antenna IA by one of the following three types of connection modes:

(A) a mode of connecting the impedance matching circuit MC1 to the whip antenna (as shown in FIG. 1A);

(B) a mode of connecting the impedance matching circuit MC1 to the built-in antenna (not shown); and (C) a mode of connecting the impedance matching circuit MC1 to both the whip antenna and the built-in antenna (as shown in FIG. 1B).

Figure 2:
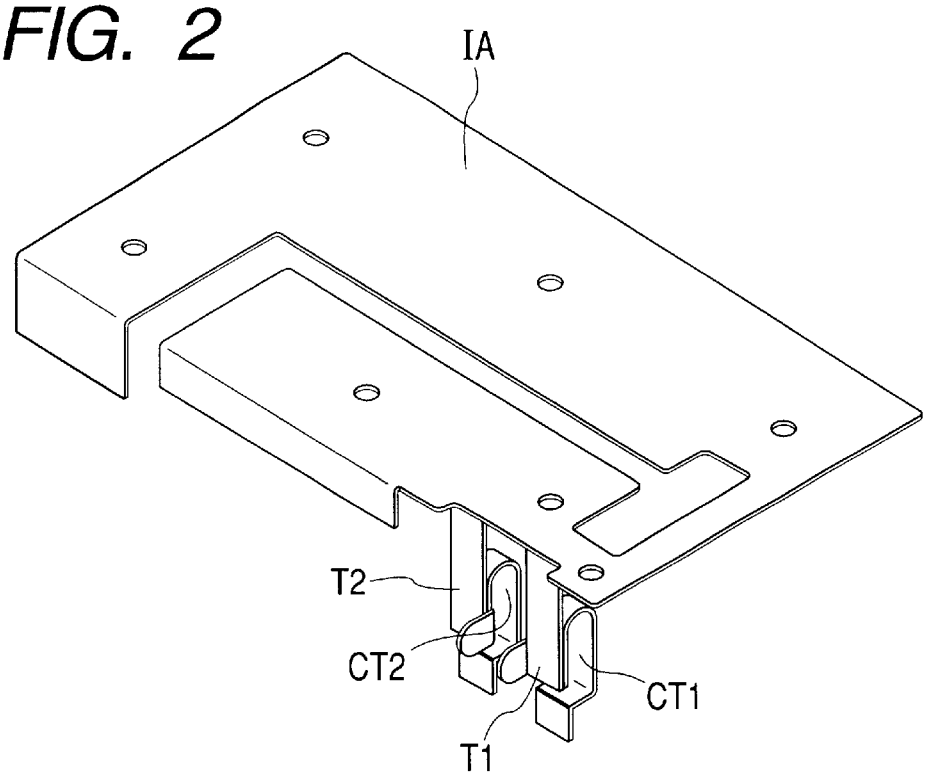
FIG. 2 is a perspective view showing the built-in antenna and the structure of a switch to be used in combination therewith.

FIG. 2 is a perspective view of a mechanical switch structure; that is, a switch to be used in the built-in antenna IA and for connecting the built-in antenna IA to the feeding circuit FC. The built-in antenna IA of plane structure is formed by folding a conductor plate. A strip-shaped feeding terminal T1 and a strip-shaped feeding terminal T2 are formed in vertical positions at one of the corners of the conductor plate. The feeding terminals T1 and T2 are provided so as to oppose each other. The feeding terminal T1 is provided with a feeding contact piece CT1 to be brought into contact with or separated from the feeding terminal T1. The feeding terminal T2 is provided with a feeding contact piece CT2 to be brought into contact with or separated from the feeding terminal T2.

The feeding contact pieces CT1 and CT2 are formed from a material having elasticity such as phosphor bronze, beryllium copper, and the thus-formed pieces are plated with gold or nickel. By the elastic property of the material, the feeding contact pieces CT1 and CT2 are brought into contact with or separated from the feeding terminal T1 and the ground terminal T2.

Figure 3A:
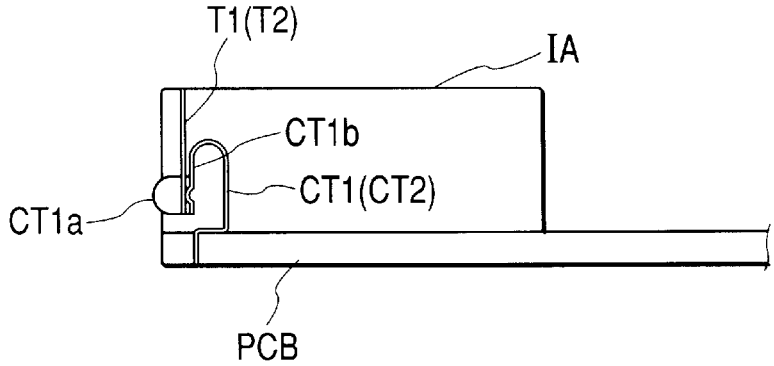
FIG. 3A is a perspective view showing the structure of the switch shown in FIG. 2 when the whip antenna is used.
Figure 3B:
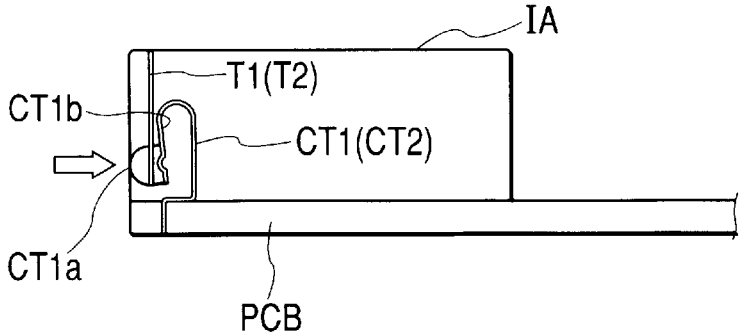
FIG. 3B is a perspective view showing the structure of the switch shown in FIG. 2 when the built-in antenna is used.

FIGS. 3A and 3B show the manner in which the feeding terminal T1 is brought into contact with or separated from the feeding contact piece CT1 and the manner in which the ground terminal T2 is brought into contact with or separated from the ground contact piece CT2. An antenna element of the built-in antenna IA is mounted on a printed circuit board (PCB). As mentioned above, the built-in antenna IA is provided with the feeding terminal T1 and the ground terminal T2. The feeding contact piece CT1 is provided at a position opposing the feeding terminal T1, and the feeding contact piece CT2 is provided at a position opposing the ground terminal T2. Descriptions relating to FIG. 3 relate solely to a relationship between the feeding terminal T1 and the feeding contact piece CT1. The ground terminal T2 and the ground contact piece CT2 are identical in construction with the feeding terminal T1 and the feeding contact piece CT1, and therefore their relationship is the same as that between the feeding terminal T1 and the feeding contact piece CT1.

The feeding contact piece CT1 is mounted on the printed circuit board PCB. The contact piece CT1 is bent into substantially the inversed-J shape. A longer side and a shorter side of the contact piece CT1 oppose each other with a bent portion interposed therebetween. Further, the contacting and separating actions of the feeding contact piece CT1 are performed, by imparting a force to a protrusion CT1 a which is perpendicular to the short side CT1*b* of the contact piece CT1 and projected toward the outside of the built-in antenna IA (toward the left in the drawing).

FIG. 3A shows a case where no force is imparted to the protrusion CT1*a,* and FIG. 3B shows a case where the short side CT1*b* is bent as a result of force being imparted to the protrusion CT1*a*. More specifically, if no force is imparted to the protrusion CT1*a*, the feeding contact piece CT1 remains in contact with the feeding terminal T1 due to its own elastic restoration force and hence remains in an electrically conducted state.

If the protrusion CT1*a* is pressed toward the right in the drawing, as indicated by an illustrated arrow, the protrusion CT1*a* and the short side CT1*b* of the feeding contact piece CT1, which is the base side of the protrusion CT1*a,* are bent in the manner as illustrated. Consequently, the feeding contact piece CT1*a* and the feeding terminal T1 separate from each other and are brought into a non-conductive state.

Figure 4B:
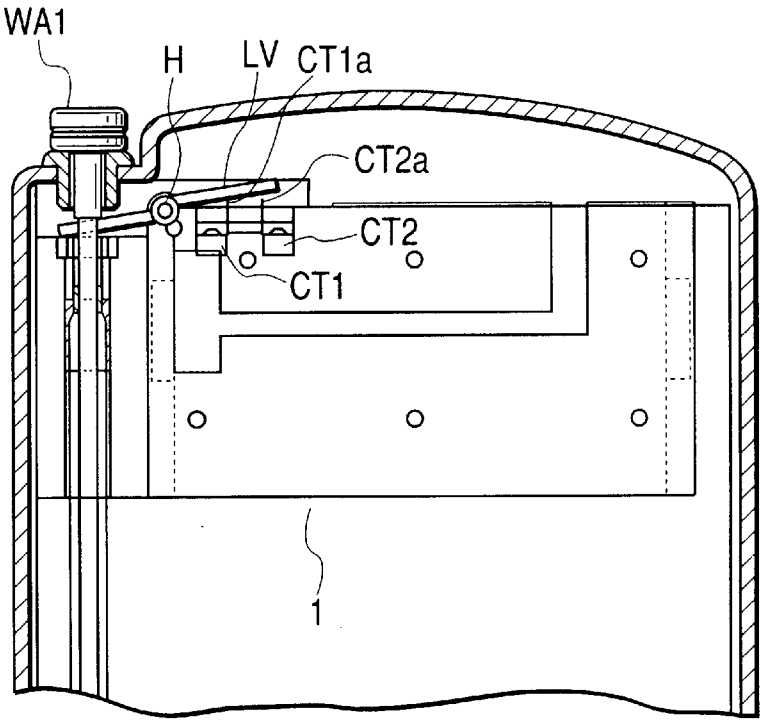
FIG. 4B is a front sectional view showing the state of a switch structure provided in the built-in antenna when the built-in antenna is used.
Figure 4A:
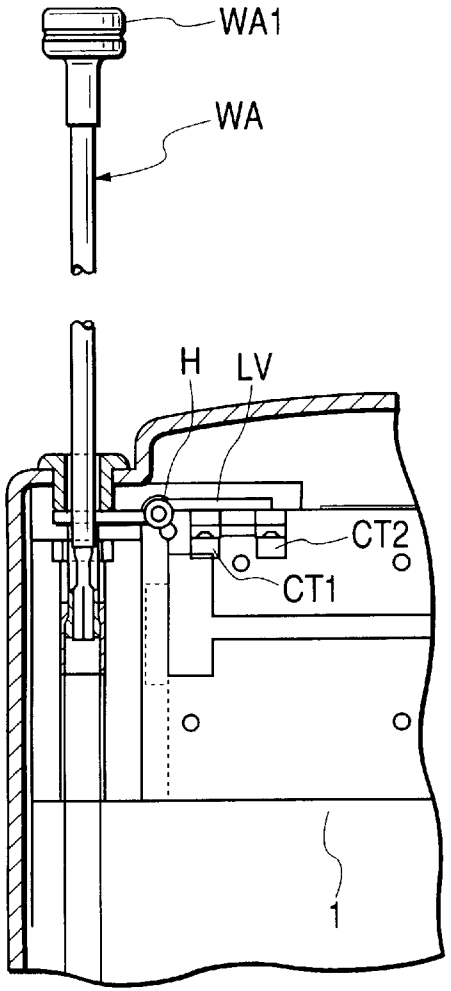
FIG. 4A is a front sectional view showing the state of a switch structure provided in the built-in antenna when the whip antenna is used.

FIGS. 4A and 4B show a cellular phone viewed from a front side thereof. These drawings show a lever LV for applying the force onto the protrusion CT1*a* of the feeding contact piece CT1 and the protrusion CT2*a* of the feeding contact piece CT2, and show the structure for operating the lever LV in accordance with the extending or housing movement of the whip antenna WA.

FIG. 4A shows the state in which the whip antenna WA is extended to its maximum length. A step formed in the whip antenna WA inserted into a through hole formed in a lever LV is brought into contact with a left-side portion of the lever LV, thereby pivoting the lever LV clockwise about a fulcrum H. Accordingly, a right-side portion of the lever LV squeezes the protrusion CT1*a* of the feeding contact piece CT1 and the protrusion CT2*a* of the ground contact piece CT2, as illustrated.

As a result, the feeding terminal T1 is disconnected from the protrusion CT1*a* of the feeding contact piece CT1, and the feeding terminal T2 is disconnected from the protrusion CT2*a* of the ground contact piece CT2.

FIG. 4B shows the state in which the whip antenna WA is housed. The left-side portion of the lever LV is pressed downward in the drawing by a lower end portion of the antenna top WA1. As a result, the lever LV is pivoted counterclockwise about the fulcrum H, thereby eliminating the force acting on the protrusion CT1*a* of the feeding contact piece CT1 and the protrusion CT2*a* of the ground contact piece CT2.

The feeding terminal T1 comes into contact with the protrusion CT1*a* of the feeding contact piece CT1, and the grounding terminal T2 comes into contact with the protrusion CT2*a* of the ground contact piece CT2. Instead of the whip antenna WA, the built-in antenna IA is connected to the feeding circuit FC.

Figure 5A:
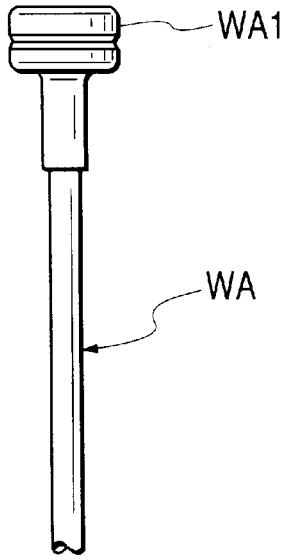
FIG. 5A is a side sectional view showing the state of the switch structure shown in FIG. 4A.
Figure 5A:
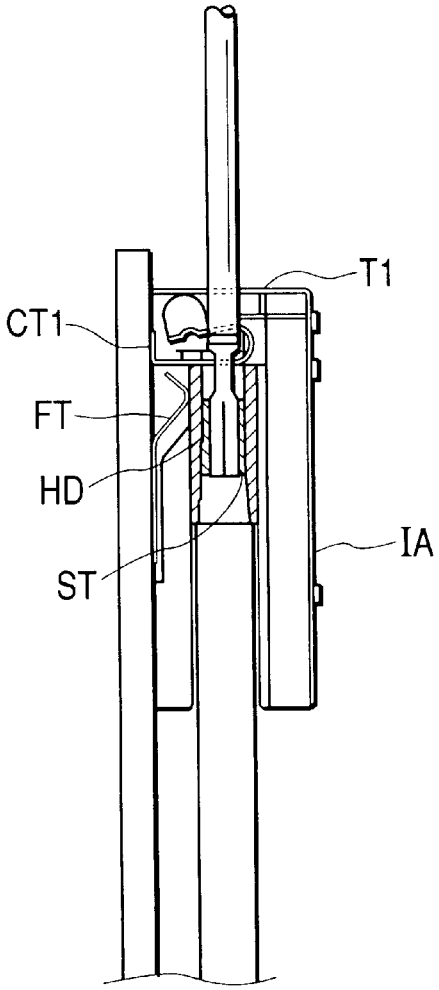
Figure 5B:
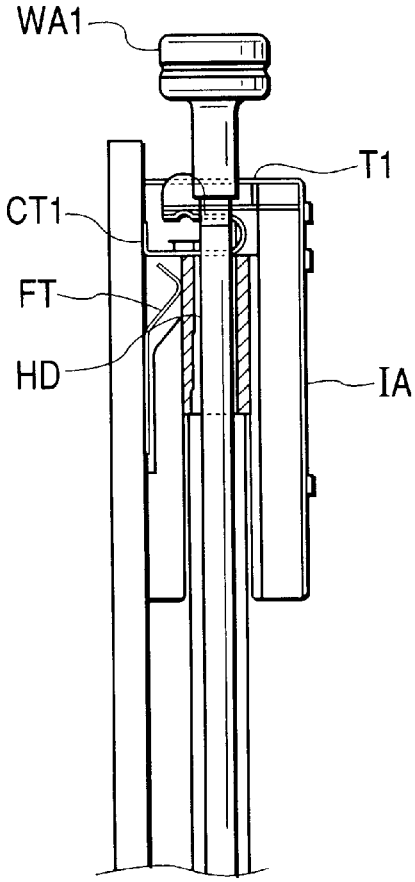
FIG. 5B is a side sectional view showing the state of the switch structure shown in FIG. 4B.

FIGS. 5A and 5B show side shapes of the antenna corresponding to those shown in FIGS. 4A and 4B, showing a mechanism for connecting or coupling the whip antenna WA to the first impedance matching circuit MC1 (shown in FIG. 1).

FIG. 5A shows the state in which the whip antenna WA has been extended to its maximum length. At this time, the stopper ST provided on an illustrated lower end of the whip antenna WA is engaged with a holder HD provided in the main body of the portable cellular phone. The stopper ST is then electrically and mechanically connected and fixed to the holder HD and further to the feeding terminal FT, which remains in contact with the holder HD at all times. The stopper ST is provided with two or four slits and spreads radially in an elastic manner. Consequently, the stopper ST is reliably retained on an internal circumferential face of the holder HD. The whip antenna WA is connected to the feeding circuit FC (shown in FIG. 1) on the circuit board connected to the feeding terminal FT.

As shown in FIG. 5B, when the whip antenna WA is housed in the main body of the portable cellular phone, the stopper ST provided on the lower end of the whip antenna WA departs from the holder HD. A plastic cladding tube of the whip antenna WA reaches the inside of the holder HD. Consequently, the whip antenna WA is separated from the feeding circuit FC (shown in FIG. 1).

Figure 6B:
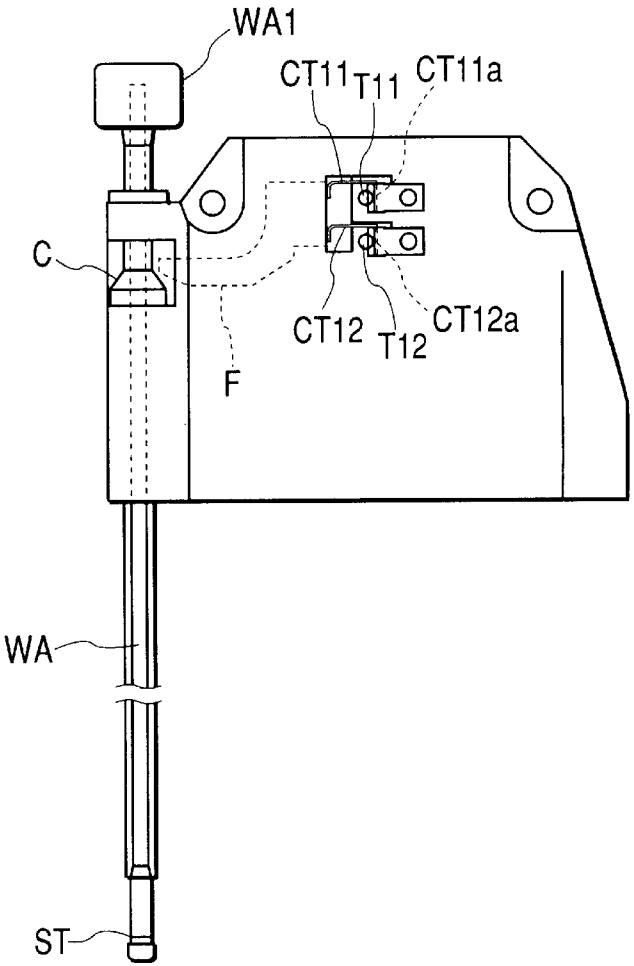
FIG. 6B is a front sectional view showing the state of a switch structure of the built-in antenna according to the second embodiment when the built-in antenna is used.
Figure 6A:
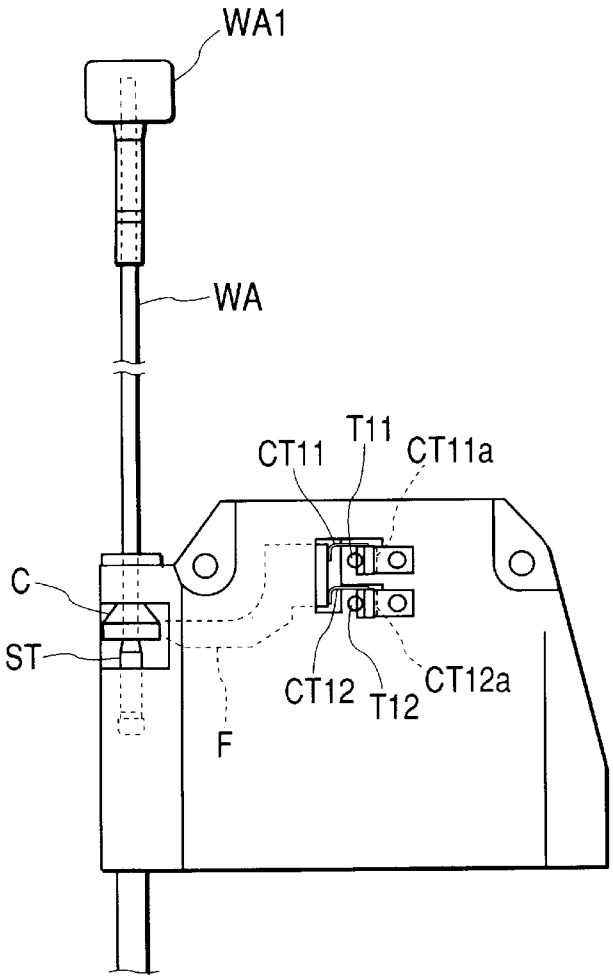
FIG. 6A is a front sectional view showing the state of a switch structure of a built-in antenna according to a second embodiment of the present invention when the whip antenna is used.
Figure 7A:
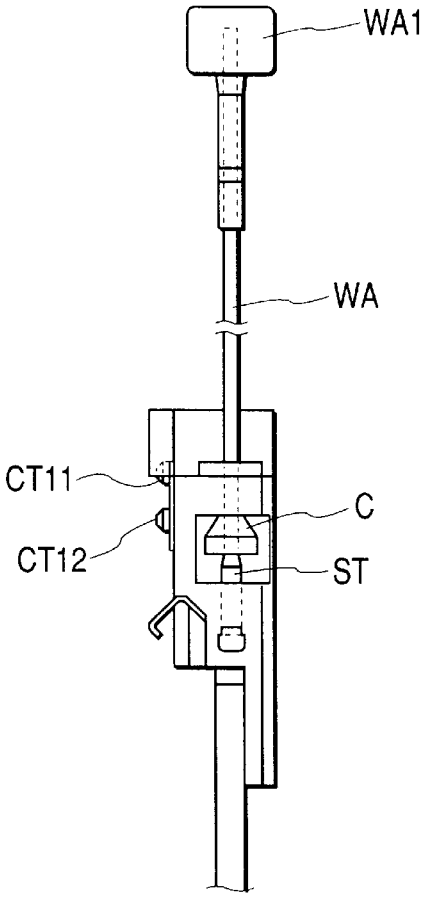
FIG. 7A is a side sectional view showing the state of the switch structure shown in FIG. 6A.
Figure 7B:
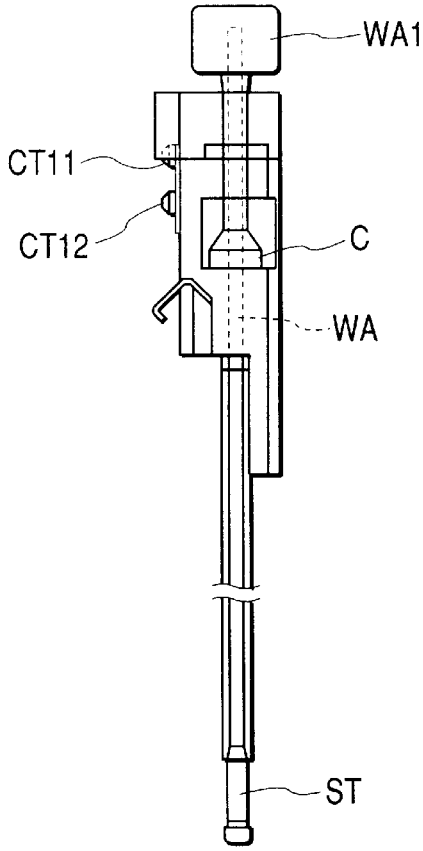
FIG. 7B is a side sectional view showing the state of the switch structure shown in FIG. 6B.
Figure 8A:
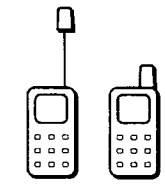
FIGS. 8A through 8D are views showing examples of cellular phones having different types of antennas.
Figure 8B:
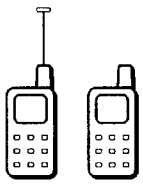
Figure 8C:
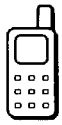
Figure 8D:
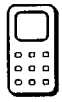

FIGS. 6A through 7B show the configuration of a switch according to a second embodiment of the present invention. FIGS. 6A and 6B show the switch when viewed from the front, and FIGS. 7A and 7B show the switch when viewed from the side.

In the present embodiment, the switch has a cam C loosely fitted around the whip antenna WA, and a follower F provided in the main body. When the whip antenna WA has been pulled to its maximum length, the cam C presses the follower F toward the right in the drawing. The follower F, which receives the leftward elastic force from the contact piece CT, is moved toward the right in the drawing when the whip antenna WA is extended to its maximum length. Moreover, when the whip antenna WA is housed in the main body, the cam C does not press the follower F, and the follower F returns toward the left in the drawing due to the elastic force of the contact piece CT.

As shown in FIG. 6A, when the whip antenna WA has been extended to its maximum length, according to the above cooperation between the cam C and the follower F, the feeding terminal is not brought into contact with feeding contact piece. As shown in FIG. 6B, when the whip antenna WA is housed, the feeding terminal is brought into contact with the feeding contact piece.

When the whip antenna WA has been extended to its maximum length, the stopper ST provided at the lower end of the whip antenna WA is press-fitted into a stopper latching hole formed in the main body. As a result, the whip antenna WA is brought into a fixed state. At this time, the cam C, which has been fitted around the whip antenna WA, presses the follower F toward the right in the drawing by way of a circumferential face of the cam. The cam C is constituted of a cone-shaped upper portion and a cylindrical lower portion. When the cam C moves upward, the follower F is pressed along a cone-shaped circumferential face of the upper portion of the cam C, thereby moving toward the right in the drawing.

Although a support mechanism of the follower F is not illustrated, the follower F is supported so as to be movable horizontally in the drawing. When the tip end of the follower F comes into contact with the cylindrical face of the lower portion of the cam C, the follower F presses the feeding contact piece CT11 and the ground contact piece CT12 toward the right side in the drawing. The contact pieces CT11 and CT12 are constituted of material having elasticity. The base sections of the contact pieces CT11 and CT12 are secured on the main body, and the extremities of erected portions of the contact pieces CT11 and CT12 are formed so as to be elastically deformable. A feeding terminal T11 is provided at a slightly-left intermediate position between the base end and extremity thereof, and a ground terminal T12 is provided at a slightly-left intermediate position between the base end and extremity thereof. Consequently, when the follower F is pressed toward the right in the drawing, the contact pieces CT11 and CT12 are separated from the feeding terminal T1 and brought into a non-contact state.

When the whip antenna WA is pressed and brought into a housed state, the follower F is brought into contact with a cone-shaped face of the cam C, as shown in FIG. 6B. Accordingly, the follower F is pressed back toward the left in the drawing under the elastic restoration force of the contact pieces CT11 and CT12. At this time, a protrusion CT11*a* provided at an intermediate position of the contact piece CT11 is brought into contact with the feeding terminal T11, and a protrusion CT12*a* provided in an intermediate position of the contact piece CT12 is brought into contact with the ground terminal T12.

As mentioned above, if the whip antenna WA is extended to its maximum length from the main body, the contact piece CT11 is separated from the terminal T11, and the contact piece CT12 is separated from the terminal T12. So long as the whip antenna WA is housed in the main body, the contact pieces CT11 and CT12 are brought into contact with the terminals T11 and T12, thereby effecting switching operation.

FIGS. 7A and 7B show the lateral profile of the switch corresponding to the switch shown in FIGS. 6A and 6B. In this case, the follower F and the contact pieces CT11 and CT12 remain behind the cam C and out of view.

The built-in antenna IA described in connection with the embodiment is to be grounded by way of the switch SW. However, grounding of the built-in antenna IA is not necessary and may be omitted.

The feeding contact piece CT1 and the ground contact piece CT2 described in connection with the embodiment may be replaced with so-called spring connectors which employ a telescopic structure and a built-in spring in combination.

The cam C described in connection with the embodiment is loosely fitted around the whip antenna WA and separated from the stopper WA2. However, the upper portion of the stopper ST may be formed integrally in the same manner as is the cam C.

As has been described above, the present invention provides an antenna for a mobile communication terminal which uses a whip antenna and a built-in antenna in a switchable manner by a switch. The whip antenna is used in combination with the impedance matching circuit and a high-impedance circuit. Hence, the antenna, although compact, can effect switching between the whip antenna and the built-in antenna.

What is claimed is:

1. An antenna device for a mobile communication terminal, comprising:

a whip antenna, which is movable between a first position corresponding to a state in which the whip antenna is extended from a casing of the mobile communication terminal, and a second position corresponding to a state the whip antenna is accommodated within the casing;

a built-in antenna, disposed within the casing;

a power feeding circuit, disposed within the casing;

a first matching circuit having a first impedance, through which the power feeding circuit and the whip antenna are electrically connected when the whip antenna is placed at the first position;

a second matching circuit having a second impedance which is higher than the first impedance, through which the whip antenna is grounded when the whip antenna is placed at the second position; and a switch mechanism, which is opened so that the built-in antenna is electrically disconnected from the power feeding circuit when the whip antenna is placed at the first position, and closed so that the built-in antenna is electrically connected to the power feeding circuit.

2. The antenna device as set forth in claim 1, wherein:

a conductive stopper member is provided on a base end of the whip antenna so as to be electrically connected with the whip antenna; and the switch mechanism includes a lever member rotated by an engaging operation of the stopper member, and at least one contact member opened or closed in cooperation with the rotation of the lever member.

3. The antenna device as set forth in claim 2, wherein the at least one contact member is integrally provided with the built-in antenna.

4. The antenna device as set forth in claim 3, wherein the at least one contact member includes at least one of a contact for opening/closing a circuit connected to the power feeding circuit and a contact for opening/closing a circuit connected to a ground level.

5. The antenna device as set forth in claim 1, wherein:

the switch mechanism includes:

a cam member, slidably fitted with the whip antenna;

a follower member, cooperated with the cam member;

a terminal member, electrically connected to the built-in antenna; and a resilient contact member, abutted against the follower member, and connected to the terminal member when the whip antenna is placed at the second position; and the cam member urges the follower member to deform the resilient contact member so that the contact member is disconnected from the terminal member, when the whip antenna is placed at the first position.

* * * * *